US012060196B1

(12) United States Patent
Ellison

(10) Patent No.: US 12,060,196 B1
(45) Date of Patent: Aug. 13, 2024

(54) ENHANCED SOUND PRODUCING LIQUID CONTAINER SYSTEM

(71) Applicant: GurglePot, Inc., Lake Tapps, WA (US)

(72) Inventor: Matthew Blake Ellison, Lake Tapps, WA (US)

(73) Assignee: GurglePot, Inc., Lake Tapps, WA (US)

( * ) Notice: Subject to any disclaimer, the term of this patent is extended or adjusted under 35 U.S.C. 154(b) by 0 days.

(21) Appl. No.: 18/412,508

(22) Filed: Jan. 13, 2024

(51) Int. Cl.
*B65D 25/02* (2006.01)
*B65D 43/02* (2006.01)
*B65D 47/06* (2006.01)

(52) U.S. Cl.
CPC ..... *B65D 25/02* (2013.01); *B65D 43/0202* (2013.01); *B65D 47/06* (2013.01); *B65D 2203/12* (2013.01)

(58) Field of Classification Search
CPC .... B65D 25/02; B65D 43/0202; B65D 47/06; B65D 2203/12
See application file for complete search history.

(56) References Cited

U.S. PATENT DOCUMENTS 396,376 A * 1/1889 Spear ..... F17C 5/06 222/39
642,787 A * 2/1900 Eakin ..... A47G 19/14 222/188
1,193,157 A * 8/1916 Anderson et al. ... B65D 25/385 222/479
1,534,670 A * 4/1925 Smith ..... A47J 27/21 222/188
3,901,417 A * 8/1975 Schiemann ..... B65D 1/20 222/479
4,273,265 A * 6/1981 Anderson ..... B67D 3/044 222/479
4,674,654 A * 6/1987 Fujii ..... B65D 51/248 222/39
5,050,780 A * 9/1991 Stone ..... A47G 19/14 222/188
5,853,114 A * 12/1998 Giovanoli ..... B65D 25/48 222/481.5
8,985,393 B1 3/2015 Ellison
2015/0321810 A1 11/2015 Ellison
2020/0002065 A1 1/2020 Ellison

* cited by examiner

*Primary Examiner* — Vishal Pancholi
(74) *Attorney, Agent, or Firm* — Grandview Law

(57) ABSTRACT

A container system includes (I) a container including a top portion, a bottom portion, and intermediate portion to form an interior of the container; and (II) a tubular member including a longitudinal tubular portion extending from the top portion toward the bottom portion, and has a cross sectional flow area taken perpendicular to a flow direction, and an expanded tubular portion extending toward the top portion with a flow direction away from the bottom portion and toward the top portion. The expanded tubular portion includes a cross sectional flow area taken perpendicular to a flow direction that is unequal to a cross sectional flow area of the longitudinal tubular portion taken perpendicular to another flow direction. In addition, other aspects are described in the claims, drawings, and text forming a part of the present disclosure.

20 Claims, 26 Drawing Sheets

ENHANCED SOUND PRODUCING LIQUID CONTAINER SYSTEM

SUMMARY

In one or more aspects a container system includes (I) a container including (A) a top portion; (B) a bottom portion; (C) at least one intermediate portion extending between the top portion and the bottom portion, wherein the top portion, the bottom portion, and the at least one intermediate portion at least partially form an interior of the container; and (II) a tubular member coupled with the top portion, the tubular member including (A) a longitudinal tubular portion coupled to the top portion of the container, (i) wherein the longitudinal tubular portion at least partially extends from the top portion toward the bottom portion, and (ii) wherein the longitudinal tubular portion includes a flow direction with a vectoral component oriented in a direction away from the top portion and toward the bottom portion, (B) an expanded tubular portion at least partially extending toward the top portion, (i) wherein the expanded tubular portion includes a flow direction with a vectoral component oriented in a direction away from the bottom portion and toward the top portion, and (ii) wherein the expanded tubular portion includes a maximum cross sectional flow area taken perpendicular to the flow direction, and (C) a flow redirection tubular portion positioned between the longitudinal tubular portion and the expanded tubular portion, (i) wherein the flow redirection tubular portion includes a plurality of flow directions including a first flow direction and a second flow direction, (a) wherein the first flow direction includes a vectoral component oriented in a direction away from the top portion and toward the bottom portion, and (b) wherein the second flow direction includes a vectoral component oriented in a direction toward the top portion and away from the bottom portion, (ii) wherein the flow redirection tubular portion includes cross sectional flow area taken perpendicular to the second flow direction, and (iv) wherein the maximum cross sectional flow area of the expanded tubular portion is greater than the maximum cross sectional flow area of the flow redirection tubular portion. Further including a sound emitter, wherein the longitudinal tubular portion is coupled to the sound emitter. Wherein the first flow direction and the second flow direction of the flow redirection portion differ by at least 60 degrees. Wherein the flow direction of the longitudinal tubular portion and the first flow direction of the flow redirection portion differ by at least 30 degrees. Wherein the expanded tubular portion includes a plurality of cross sectional flow areas taken perpendicular to the flow direction of the expanded tubular portion, and wherein at least of portion of the plurality of cross sectional flow areas increase in size based on increasing distance away from the flow redirection portion along the flow direction of the expanded tubular portion. Wherein the longitudinal tubular portion includes a portion with a constant cross sectional flow area taken perpendicular to the flow direction of the longitudinal tubular portion. Wherein the longitudinal tubular portion includes a portion with a constant internal diameter taken perpendicular to the flow direction of the longitudinal tubular portion. Wherein the longitudinal tubular portion includes a volume, the redirection tubular portion includes a volume, and the expanded tubular portion includes a volume, and wherein the sum of the volume of the longitudinal tubular portion and the volume of the redirection tubular portion is greater than the volume of the expanded tubular portion. Wherein the redirection tubular portion includes a volume, and the expanded tubular portion includes a volume, and wherein the volume of the expanded tubular portion is greater than the volume of the redirection tubular portion. Wherein the plurality of flow directions of the flow redirection tubular portion includes a third flow direction equal to the flow direction expanded tubular portion, wherein the flow redirection tubular portion includes a maximum cross sectional flow area taken perpendicular to the third flow direction, wherein the expanded tubular portion includes a minimum cross sectional flow area taken perpendicular to the flow direction of the expanded tubular portion, and wherein the maximum cross sectional flow area taken perpendicular to the third flow direction of the redirection tubular portion is smaller than the minimum cross sectional flow area of the expanded tubular portion. Wherein the at least one intermediate portion includes at least one curvilinear geometry. Further including a fluid outlet coupled in fluid communication with the at least one intermediate portion. Further including a fluid outlet coupled in fluid communication with the top portion. Wherein the container further includes a lid, and wherein the lid is removably coupled to the top portion of the container. Wherein the flow direction of the longitudinal tubular portion is not equal to any of the plurality of flow directions of the flow redirection tubular portion.

In one or more aspects a container system includes (I) a container including (A) a top portion; (B) a bottom portion; (C) at least one intermediate portion extending between the top portion and the bottom portion, wherein the top portion, the bottom portion, and the at least one intermediate portion at least partially form an interior of the container; and (II) a tubular member coupled with the top portion, the tubular member including (A) a longitudinal tubular portion coupled to the top portion of the container, (i) wherein the longitudinal tubular portion at least partially extends from the top portion toward the bottom portion, (ii) wherein the longitudinal tubular portion includes a flow direction with a vectoral component oriented in a direction away from the top portion and toward the bottom portion, and (iii) wherein the longitudinal tubular portion includes a minimum cross sectional flow area taken perpendicular to the flow direction, and (B) an expanded tubular portion at least partially extending toward the top portion, (i) wherein the expanded tubular portion includes a flow direction with a vectoral component oriented in a direction away from the bottom portion and toward the top portion, (ii) wherein the expanded tubular portion includes a maximum cross sectional flow area taken perpendicular to the flow direction, and (iii) wherein the minimum cross sectional flow area of the longitudinal tubular portion is less than the maximum cross sectional flow area of the expanded tubular portion. Wherein the longitudinal tubular portion includes a portion with a constant cross sectional flow area taken perpendicular to the flow direction of the longitudinal tubular portion. Wherein the longitudinal tubular portion includes a volume, the redirection tubular portion includes a volume, and the expanded tubular portion includes a volume, and wherein the sum of the volume of the longitudinal tubular portion and the volume of the redirection tubular portion is greater than the volume of the expanded tubular portion.

In one or more aspects a container system including (I) a container including (A) a top portion; (B) a bottom portion; (C) at least one intermediate portion extending between the top portion and the bottom portion, wherein the top portion, the bottom portion, and the at least one intermediate portion at least partially form an interior of the container; and (II) a tubular member coupled with the top portion, the tubular member including (A) a longitudinal tubular portion coupled to the top portion of the container, (i) wherein the longitudinal tubular portion at least partially extends from the top portion toward the bottom portion, (ii) wherein the longitudinal tubular portion includes a flow direction with a vectoral component oriented in a direction away from the top portion and toward the bottom portion, and (iii) wherein the longitudinal tubular portion includes a minimum cross sectional flow area taken perpendicular to the flow direction, and (B) an expanded tubular portion at least partially extending toward the top portion, (i) wherein the expanded tubular portion includes a flow direction with a vectoral component oriented in a direction away from the bottom portion and toward the top portion, (ii) wherein the expanded tubular portion includes a maximum cross sectional flow area taken perpendicular to the flow direction, and (iii) wherein the maximum cross sectional flow area of the longitudinal tubular portion is less than the minimum cross sectional flow area of the expanded tubular portion. Wherein the flow direction of the longitudinal tubular portion is not equal to any flow direction of the expanded tubular portion.

BRIEF DESCRIPTION OF THE FIGURES

For a more complete understanding of implementations, reference now is made to the following descriptions taken in connection with the accompanying drawings. The use of the same symbols in different drawings typically indicates similar or identical items, unless context dictates otherwise.

With reference now to the figures, shown are one or more examples of an enhanced sound producing liquid container system, articles of manufacture, compositions of matter for same that may provide context, for instance, in introducing one or more implementations described herein.

DETAILED DESCRIPTION

Figure 1:
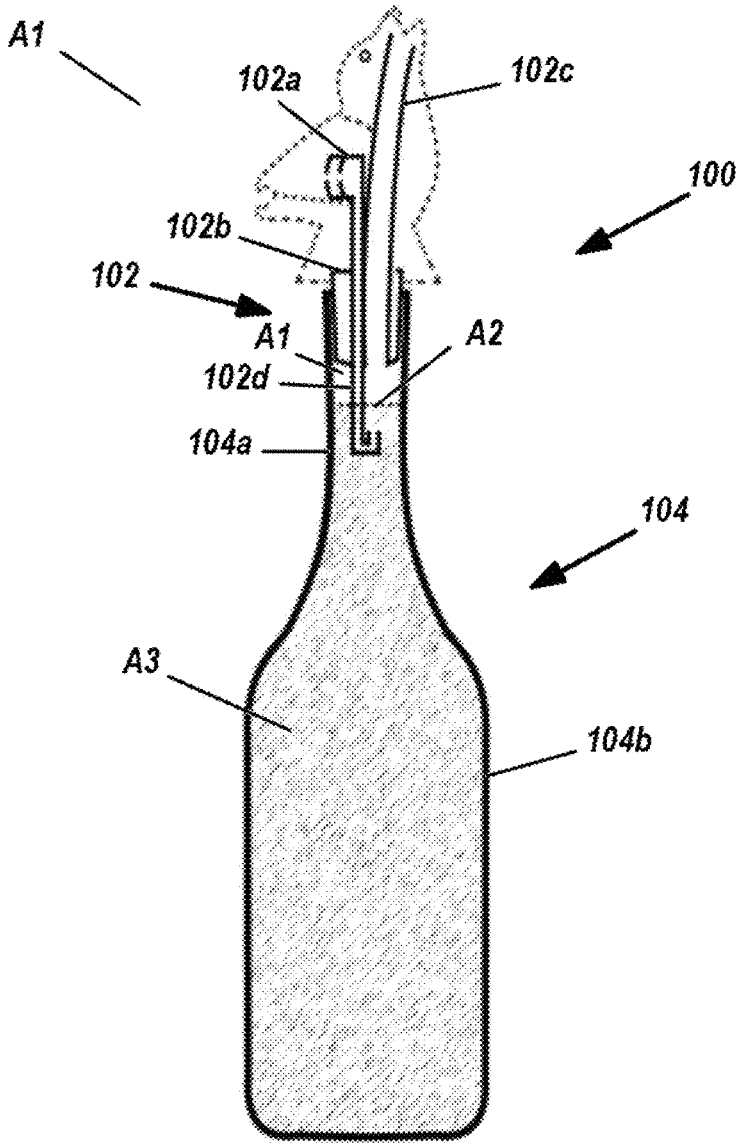
Fig. 1 (Prior Art)
FIG. 1 is a side elevational cross-sectional view of a conventional sound producing liquid container system in upright position.

In the following detailed description, reference is made to the accompanying drawings, which form a part hereof. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here.

Turning to FIG. 1, depicted therein is a side elevational cross-sectional view of conventional container system 100 in upright position. In implementations, conventional container system 100 is shown to include emitter-dispenser assembly 102, and container 104. In implementations, emitter-dispenser assembly 102 is shown to include sound emitter 102*a*, stopper 102*b*, tubular member 102*c*, and tubular member 102*d*. In implementations, container 104 is shown to include 104*a* containing ambient air A1 and a portion of liquid A3 with ambient liquid level A2 therebetween, and including body 104*b* containing a portion of liquid A3.

Figure 2:
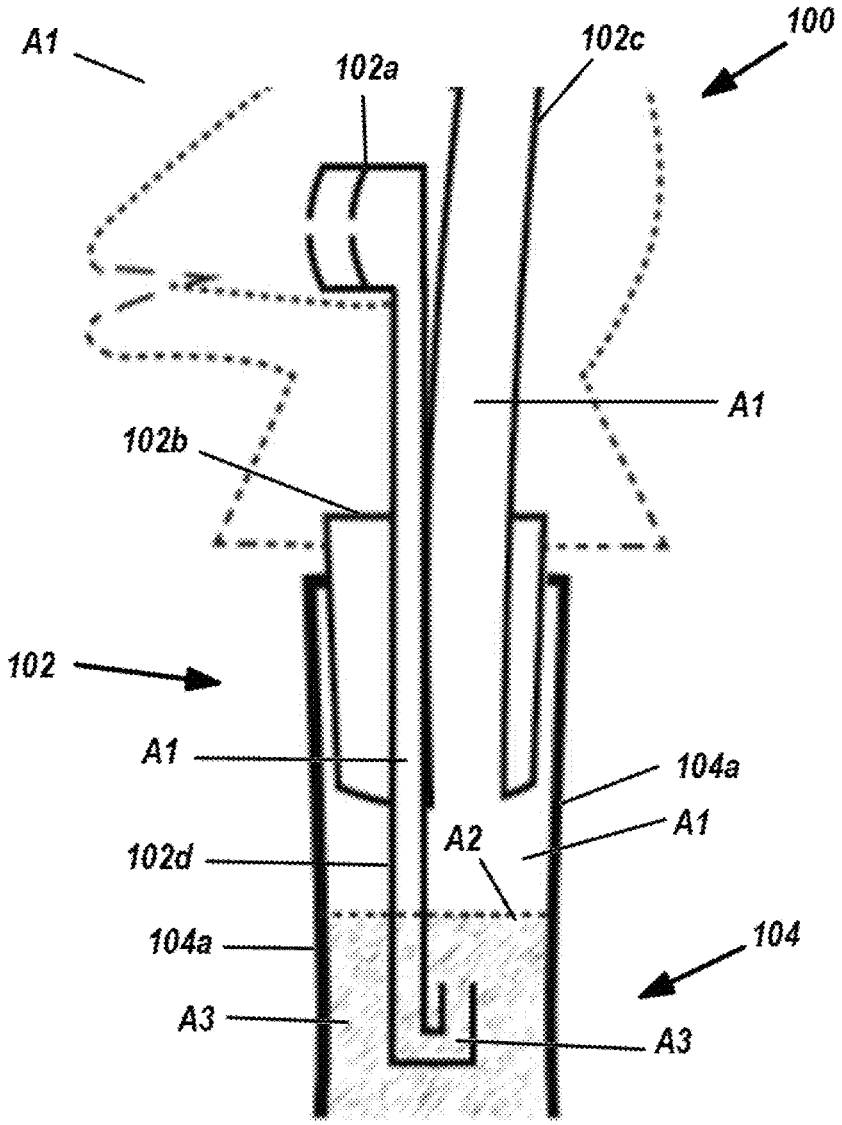
Fig. 2 (Prior Art)
FIG. 2 is an enlarged side elevational cross-sectional view of a portion of the conventional sound producing liquid container system of FIG. 1 in upright position.

Turning to FIG. 2, depicted therein is an enlarged side elevational cross-sectional view of a portion of conventional container system 100 in upright position wherein an upper portion of tubular member 102*d* contains ambient air A1 and a lower portion of tubular member 102*d* contains a portion of liquid A3.

Figure 3:
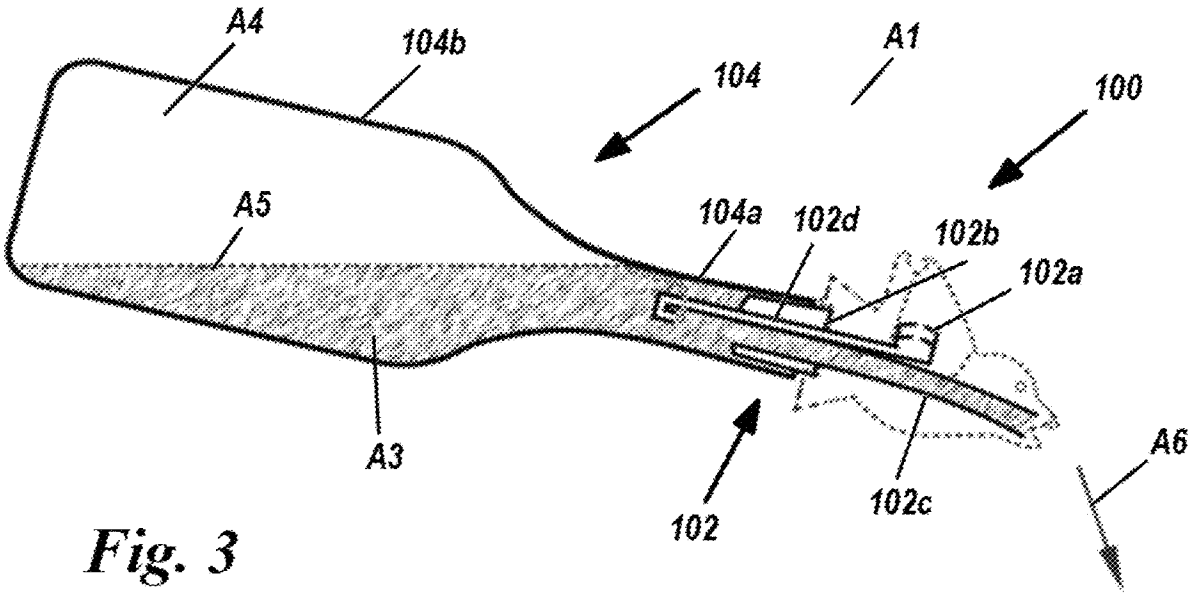
Fig. 3 (Prior Art)
FIG. 3 is a side elevational cross-sectional view of the conventional sound producing liquid container system of FIG. 1 in a first tilted position.

Turning to FIG. 3, depicted therein is a side elevational cross-sectional view of conventional container system 100 in a first tilted position which results in contained liquid level A5 of liquid A3 between liquid A3 and contained air A4 trapped by body 104*b* as liquid A3 exits container 104 through tubular member 102*c* as shown by dispensed liquid A6.

Figure 4:
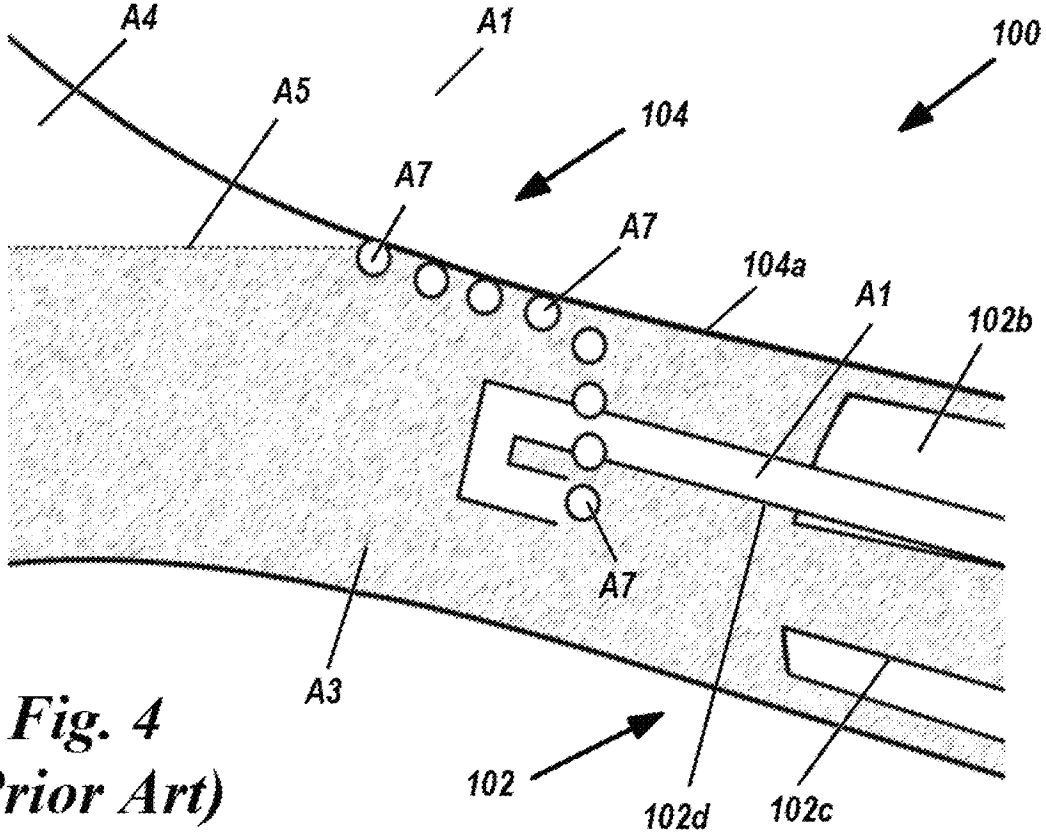
Fig. 4 (Prior Art)
FIG. 4 is an enlarged side elevational cross-sectional view of a portion of the conventional sound producing liquid container system of FIG. 1 in the first tilted position.

Turning to FIG. 4, depicted therein is an enlarged side elevational cross-sectional view of a portion of conventional container system 100 in the first tilted position better showing air bubble A7 from ambient air A1 of tubular member 102*d* passing through liquid A3 and past contained liquid level A5 into contained air A4. Production of pluralities of air bubble A7 can result in continual fluctuating flow of ambient air A1 in tubular member 102*d* thereby resulting in continually fluctuating sound production of sound emitter 102*a* compared with steady sound production of sound emitter 102*a* when steady flow of ambient air A1 is occurring through sound emitter 102*a*.

Figure 5:
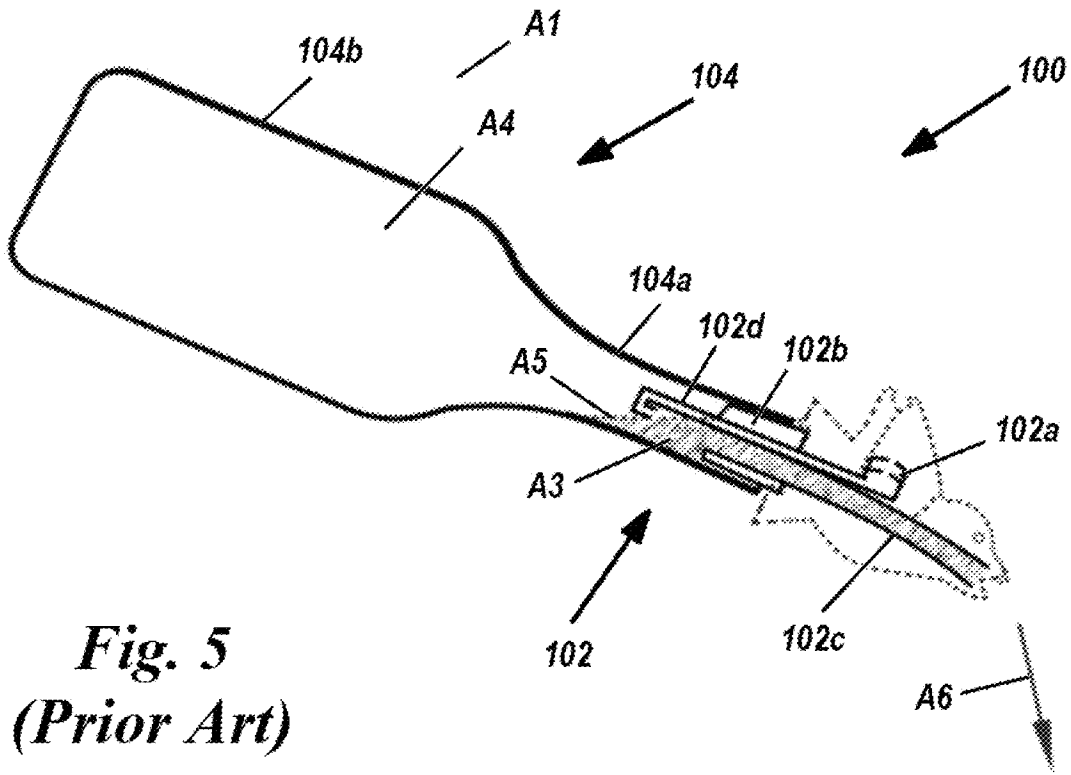
Fig. 5 (Prior Art)
FIG. 5 is a side elevational cross-sectional view of the conventional sound producing liquid container system of FIG. 1 in a second tilted position.

Turning to FIG. 5, depicted therein is a side elevational cross-sectional view of conventional container system 100 in a second tilted position with liquid A3 further exiting tubular member 102*c* as shown by dispensed liquid A6 and with contained liquid level A5 below the end of tubular member 102*d* that is inside 104*a* without any of liquid A3 being inside of tubular member 102*d* thereby ceasing both fluctuating flow of ambient air A1 in tubular member 102*d* and fluctuating sound production of sound emitter 102*a*.

Figure 6:
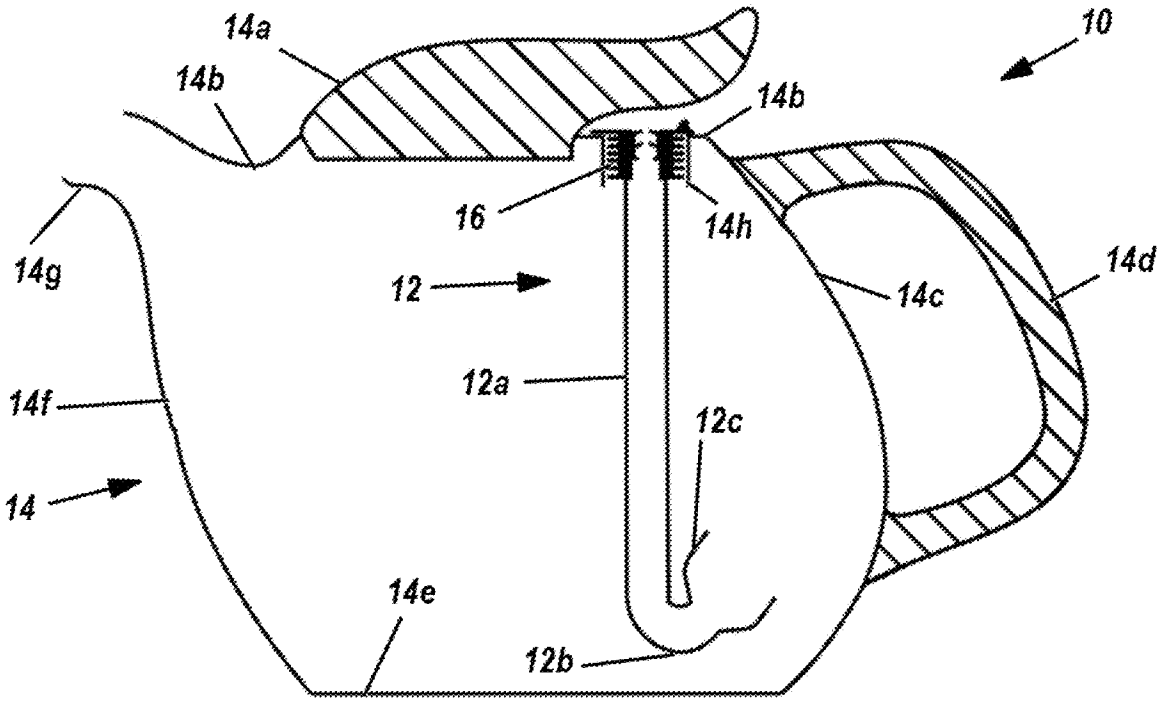
FIG. 6 is a side elevational cross-sectional view of an enhanced sound producing liquid container system in upright position and empty liquid condition.

Turning to FIG. 6, depicted therein is a side elevational cross-sectional view of enhanced container system 10 in upright position and empty liquid condition. In implementations, enhanced container system 10 is shown to include tubular member 12, container assembly 14, and sound emitter 16. In implementations, tubular member 12 is shown to include longitudinal portion 12*a*, redirection portion 12*b*, and expanded portion 12*c*. In implementations, container assembly 14 is shown to include removable lid 14*a*, top portion 14*b*, intermediate portion 14*c*, handle portion 14*d*, bottom portion 14*e*, intermediate portion 14*f*, and fluid outlet 14*g*. In implementations, can be fastened through gravity, friction, threaded engagement, etc. As depicted, intermediate portion 14*c* and intermediate portion 14*f* extend between top portion 14*b* and bottom portion 14*e* to form a pot-like shape but in other implementations container assembly 14 can have other curvilinear and/or linear geometries such as cylindrical, rectangular, etc. As depicted, fluid outlet 14*g* is coupled to top portion 14*b* and intermediate portion 14*f* and but in other implementations fluid outlet 14*g* can be coupled to removable lid 14*a*. In implementations tubular member 12 is shown coupled to sound emitter 16, which are both coupled to top portion 14*b* of container assembly 14. In other implementations tubular member 12 is coupled to sound emitter 16, which can be both coupled to removable lid 14*a*.

Figure 7:
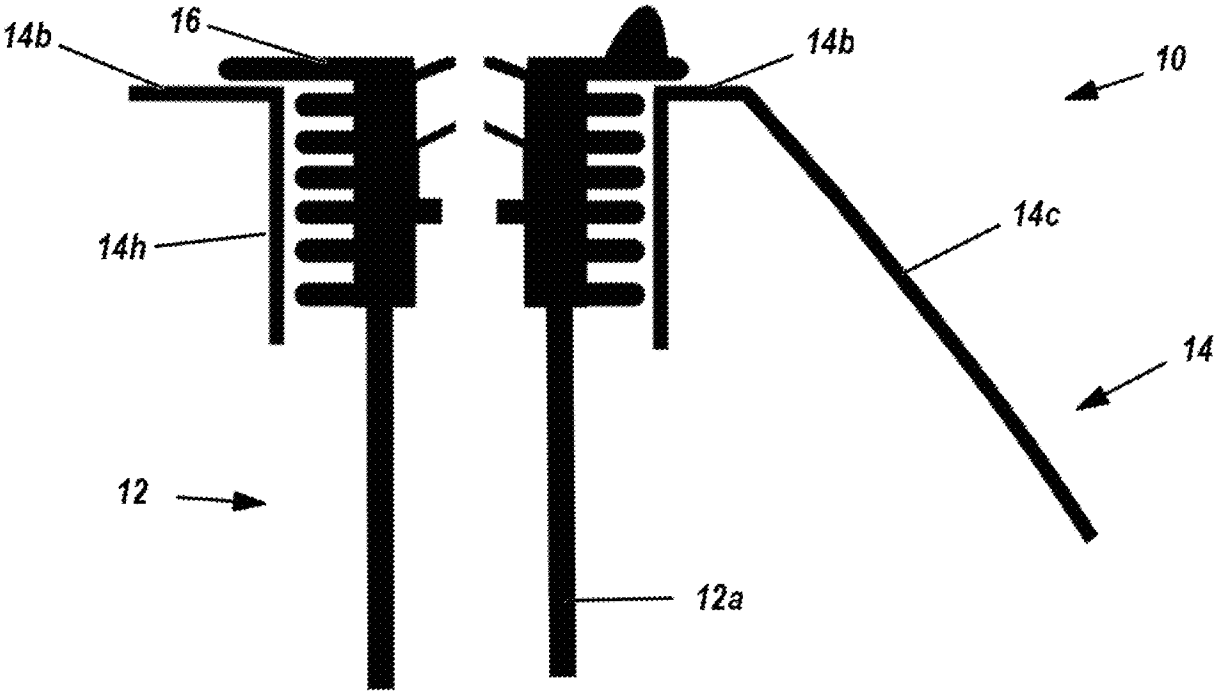
FIG. 7 is an enlarged side elevational cross-sectional view of a first portion of the enhanced sound producing liquid container system of FIG. 6 in upright position and empty liquid condition.

Turning to FIG. 7, depicted therein is an enlarged side elevational cross-sectional view of a first portion of enhanced container system 10 in upright position and empty liquid condition.

Figure 8:
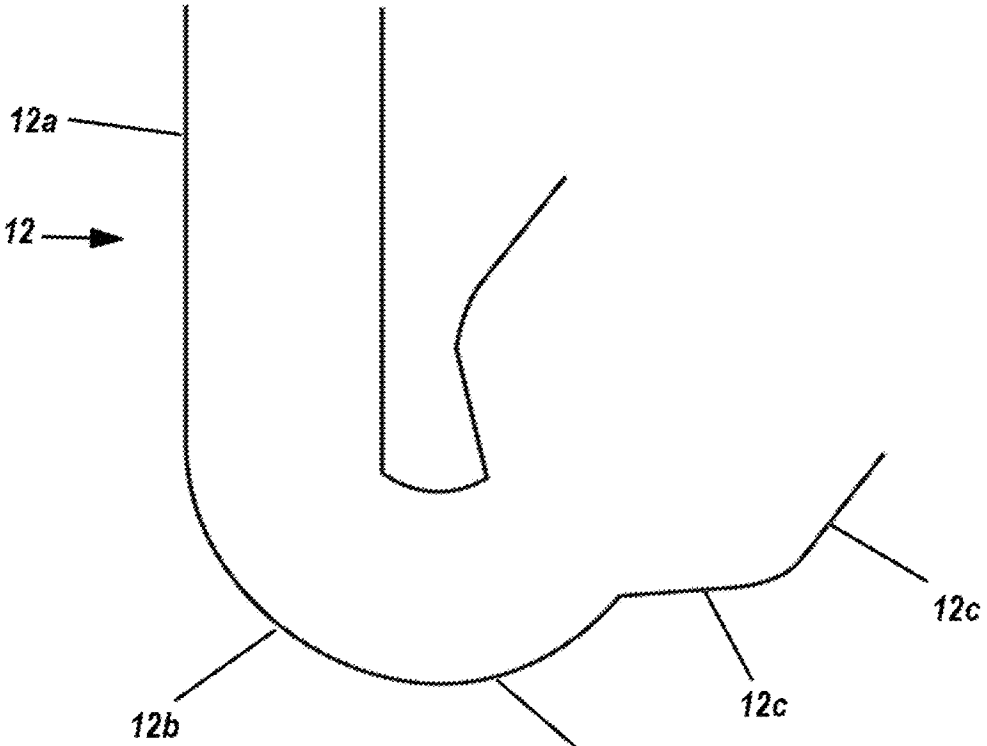
FIG. 8 is an enlarged side elevational cross-sectional view of a second portion of the enhanced sound producing liquid container system of FIG. 6 in upright position and empty liquid condition.

Turning to FIG. 8, depicted therein is an enlarged side elevational cross-sectional view of a second portion of enhanced container system 10 in upright position and empty liquid condition.

Figure 9:
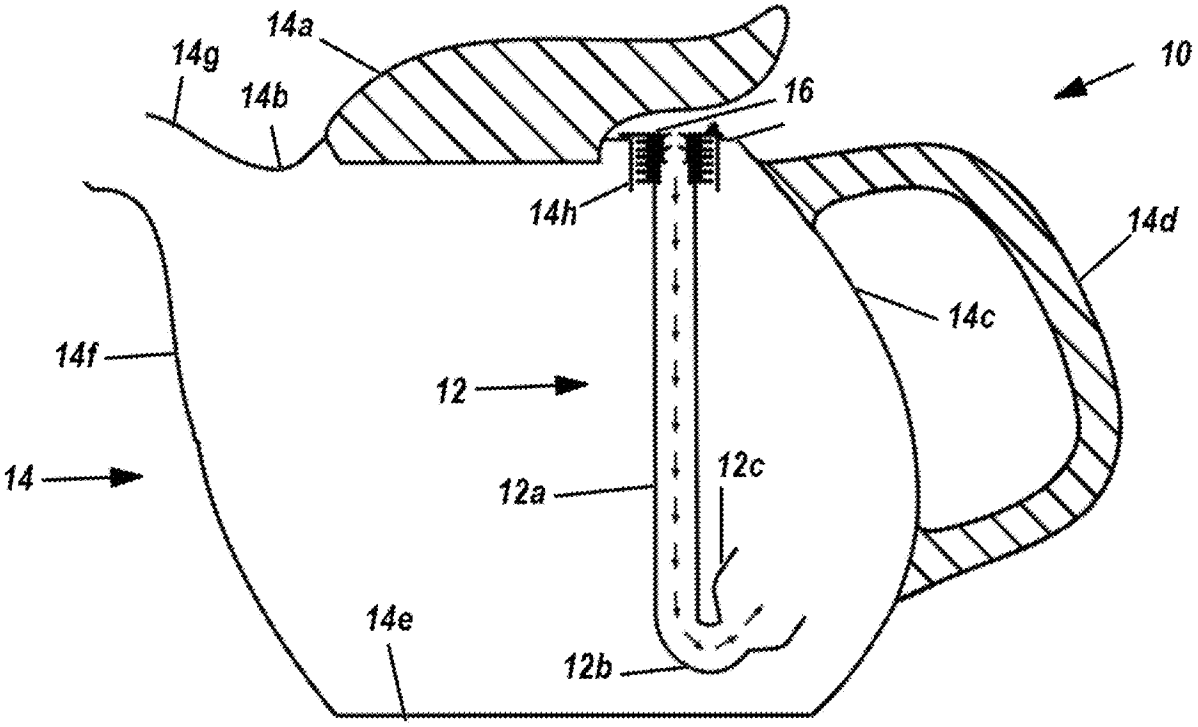
FIG. 9 is a side elevational cross-sectional view of an enhanced sound producing liquid container system in upright position and empty liquid condition.

Turning to FIG. 9, depicted therein is a side elevational cross-sectional view of enhanced container system 10 in upright position and empty liquid condition showing flow directions of tubular member 12. These flow direction indictors are showing how the tubular member 12 is constructed to have various flow directions so that "flow direction" is a term used herein to describe geometries of tubular member 12 structure irrespective of actual fluid flow. However, if fluid was flowing inside of tubular member 12, the fluid would be flowing with respect to the geometries of tubular member 12 as described by the geometrical term "flow direction" of the tubular member 12 structure.

Figure 10:
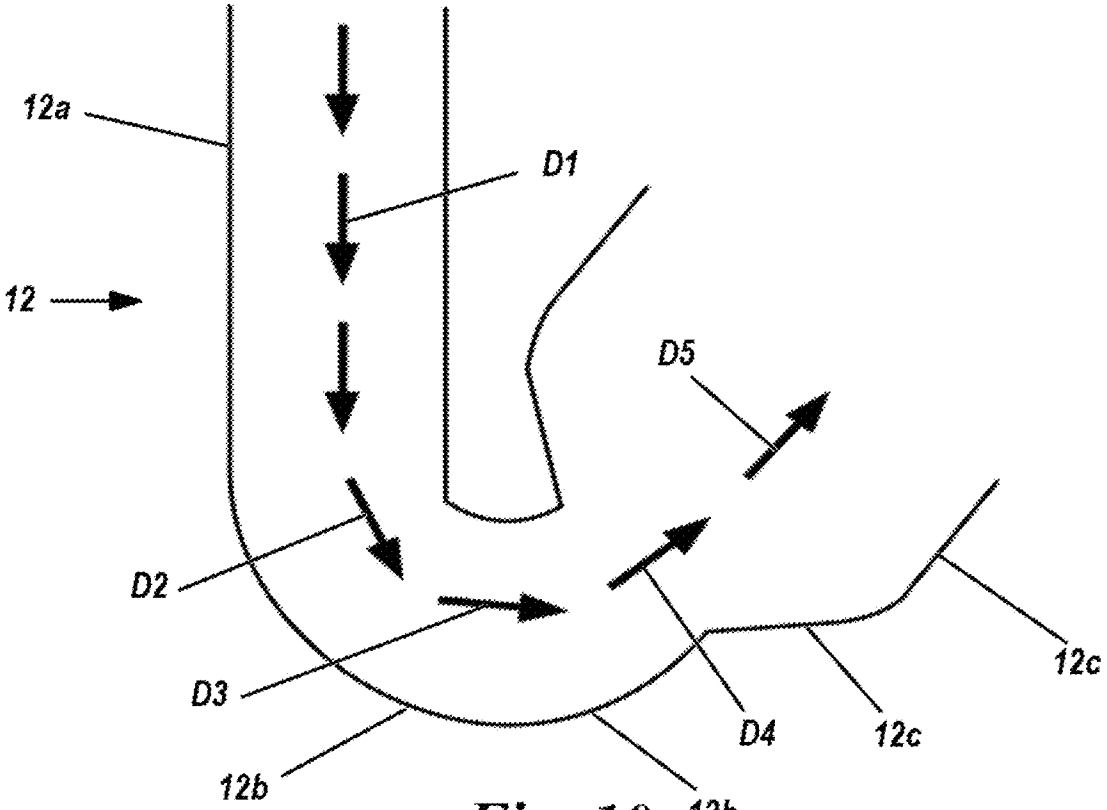
FIG. 10 is an enlarged side elevational cross-sectional view of the second portion of the enhanced sound producing liquid container system of FIG. 6 in upright position and empty liquid condition.

Turning to FIG. 10, depicted therein is an enlarged side elevational cross-sectional view of the second portion of enhanced container system 10 in upright position and empty liquid condition. tubular member 12 is depicted with exemplary flow direction indicator D1, flow direction indicator D2, flow direction indicator D3, flow direction indicator D4, and flow direction indicator D5. To reiterate that stated above These flow direction indictors are showing how the tubular member 12 is constructed to have various flow directions so that flow direction is a term used herein to describe geometries of tubular member 12 structure irrespective of actual fluid flow. However, if fluid was flowing inside of tubular member 12, the fluid be would be flowing with respect to the geometries of tubular member 12 as described by the geometrical term "flow direction" of the tubular member 12 structure. A refinement to this point is that in some implementations there can be more complicated tubular geometries at particular locations that require the term "flow direction" to also account for an aggregate sum or average "flow direction" at a particular location. Since the term "flow direction" involves direction, it also follows that vectoral components can be associated with this "flow direction" term. This term "flow direction" can also be used to help specify the geometrical cross-sectional area at particular locations of tubular member 12 such as by the phraseology of "cross sectional flow area taken perpendicular to a particular flow direction." These cross-sectional areas in some implementations and locations in tubular member 12 can based on circular shaped cross-sections but in other implementations or locations in tubular member 12 can be based on non-circular shaped cross-sections.

Figure 11:
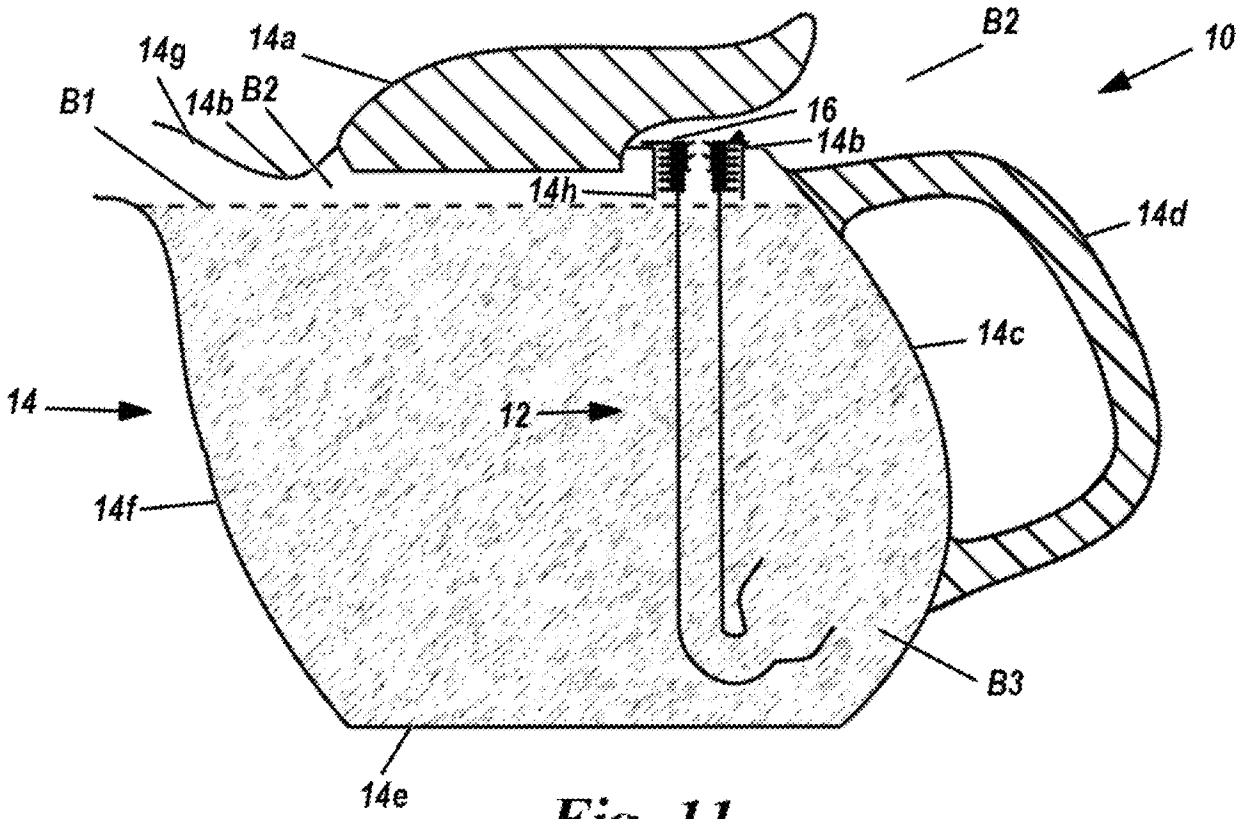
FIG. 11 is an enlarged side elevational cross-sectional view of the enhanced sound producing liquid container system of FIG. 6 in upright position and first liquid level condition.

Turning to FIG. 11, depicted therein is an enlarged side elevational cross-sectional view of enhanced container system 10 in upright position and first liquid level condition with ambient liquid level B1, ambient air B2, and liquid B3.

Figure 12:
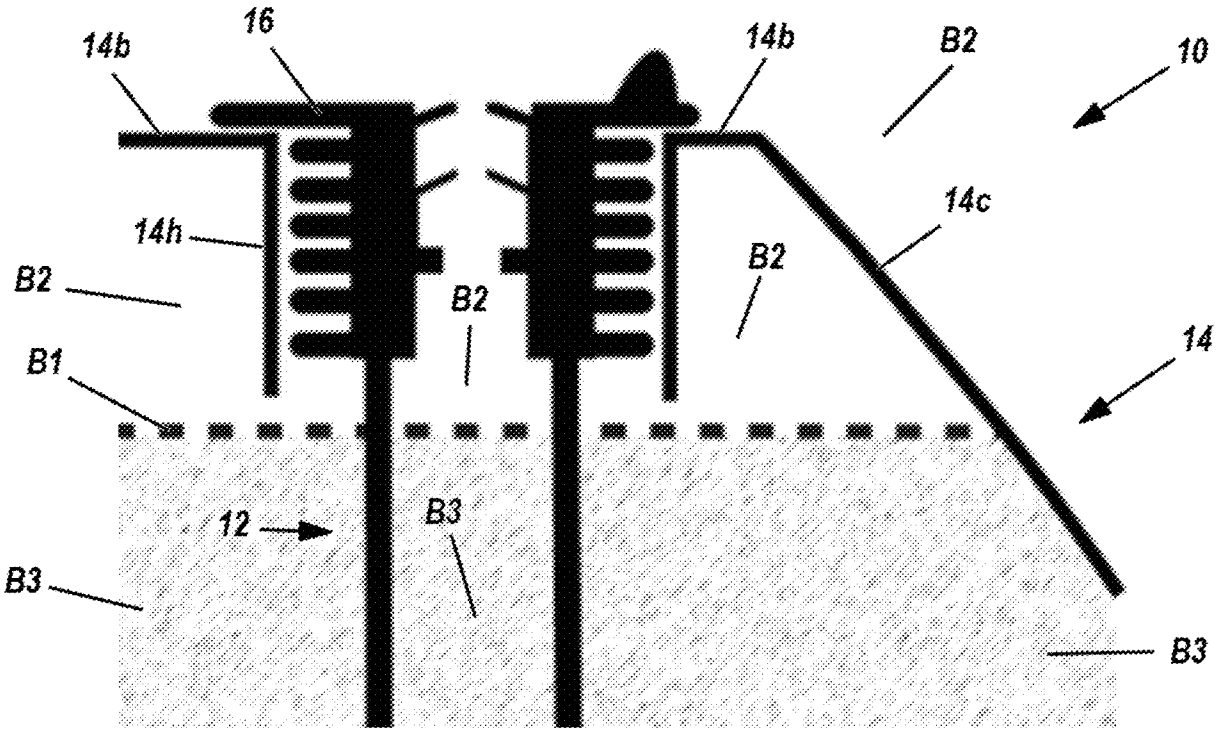
FIG. 12 is an enlarged side elevational cross-sectional view of the first portion of the enhanced sound producing liquid container system of FIG. 6 in upright position and first liquid level condition.

Turning to FIG. 12, depicted therein is an enlarged side elevational cross-sectional view of the first portion of enhanced container system 10 in upright position and first liquid level condition.

Figure 13:
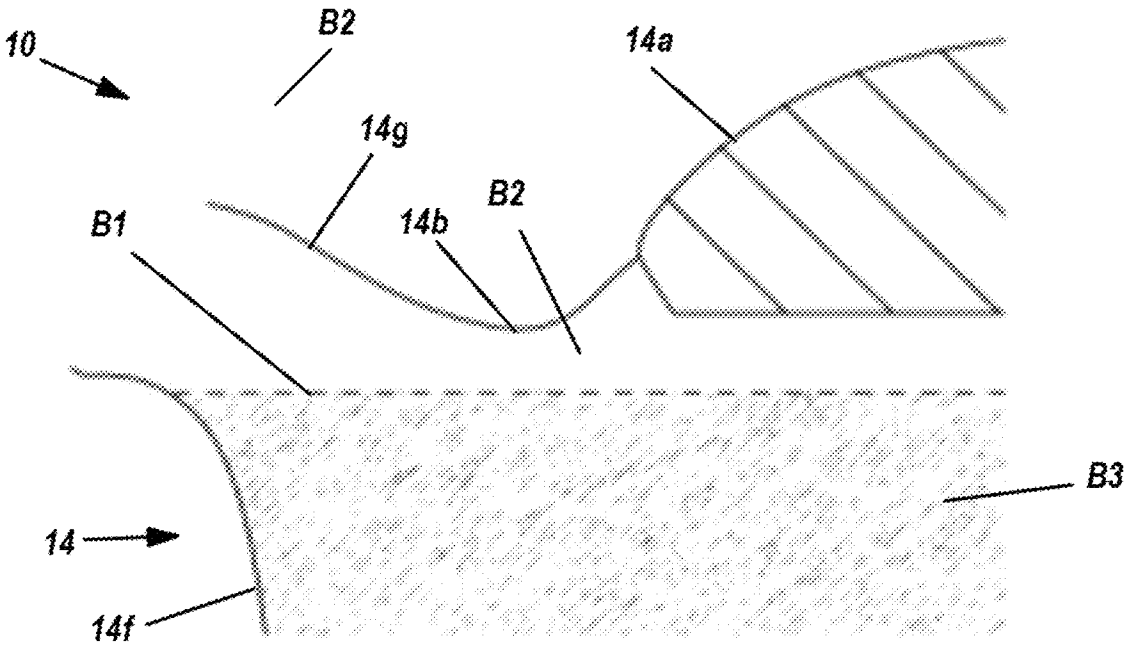
FIG. 13 is an enlarged side elevational cross-sectional view of a third portion of the enhanced sound producing liquid container system of FIG. 6 in upright position and first liquid level condition.

Turning to FIG. 13, depicted therein is an enlarged side elevational cross-sectional view of a third portion of enhanced container system 10 in upright position and first liquid level condition.

Figure 14:
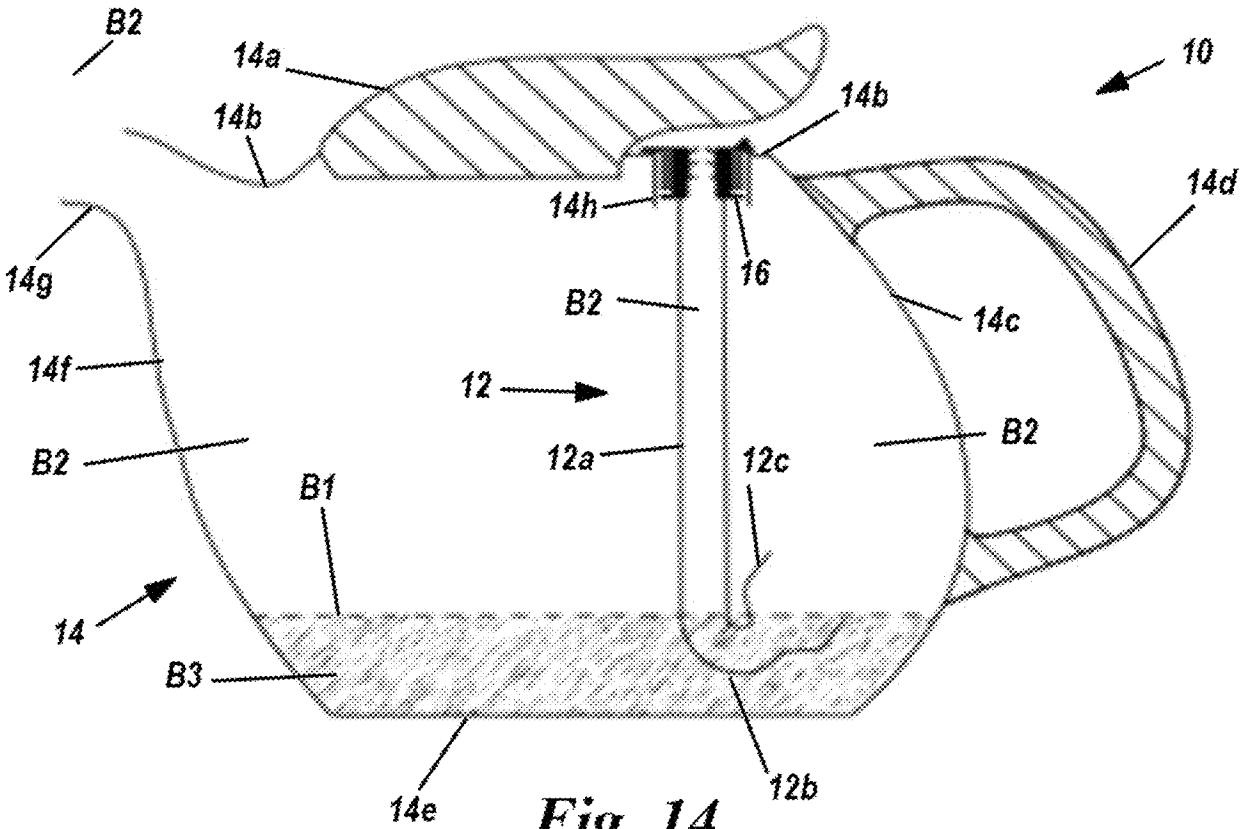
FIG. 14 is an enlarged side elevational cross-sectional view of the enhanced sound producing liquid container system of FIG. 6 in upright position and second liquid level condition.

Turning to FIG. 14, depicted therein is an enlarged side elevational cross-sectional view of enhanced container system 10 in upright position and second liquid level condition.

Figure 15:
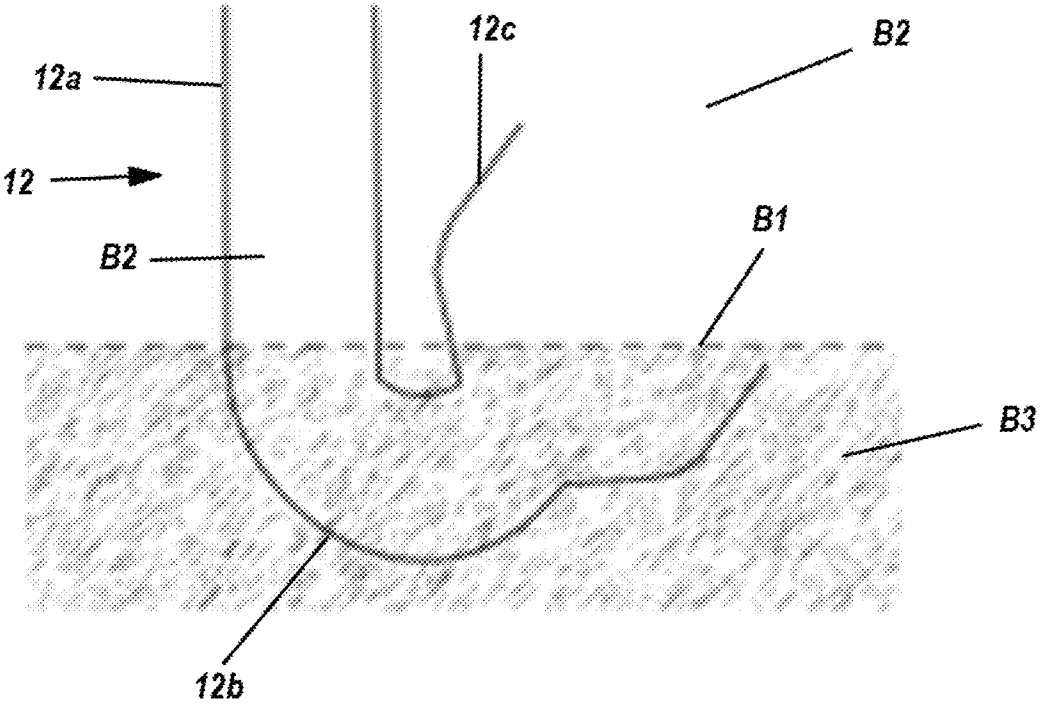
FIG. 15 is an enlarged side elevational cross-sectional view of the second portion of the enhanced sound producing liquid container system of FIG. 6 in upright position and second liquid level condition.

Turning to FIG. 15, depicted therein is an enlarged side elevational cross-sectional view of enhanced container system 10 in upright position and second liquid level condition.

Figure 16:
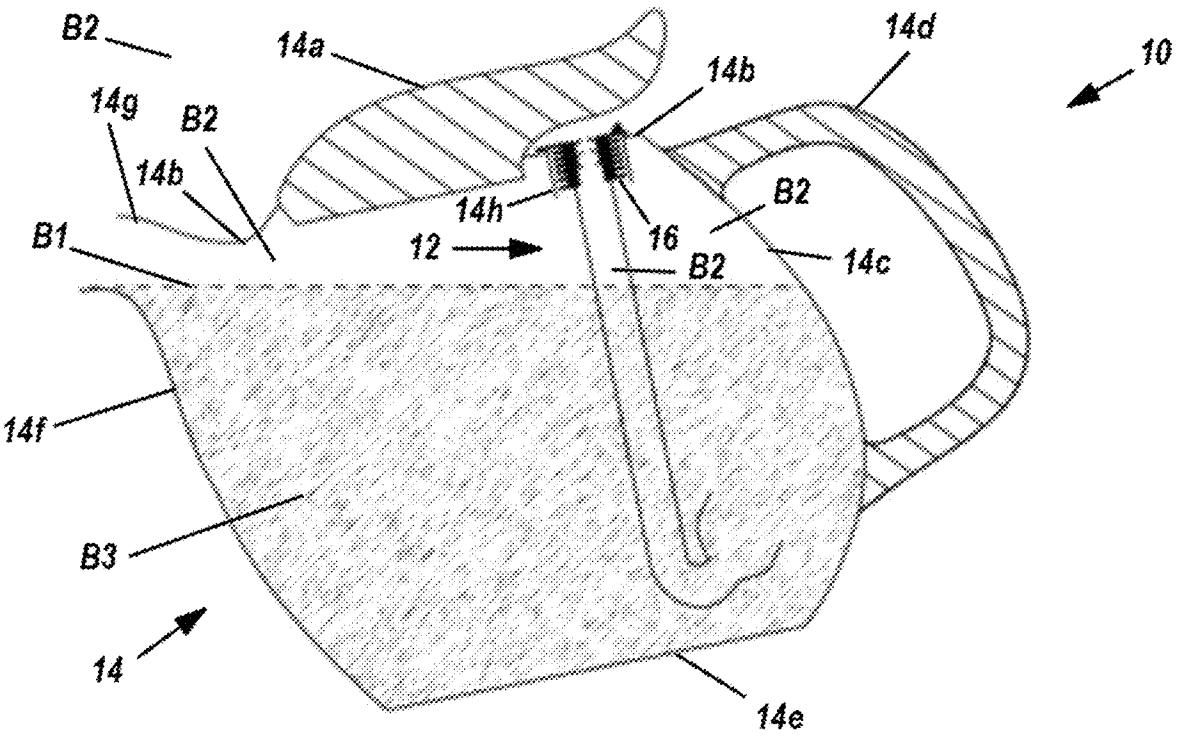
FIG. 16 is a side elevational cross-sectional view of the enhanced sound producing liquid container system of FIG. 6 in first tilted position and third liquid level condition.

Turning to FIG. 16, depicted therein is a side elevational cross-sectional view of enhanced container system 10 in first tilted position and third liquid level condition.

Figure 17:
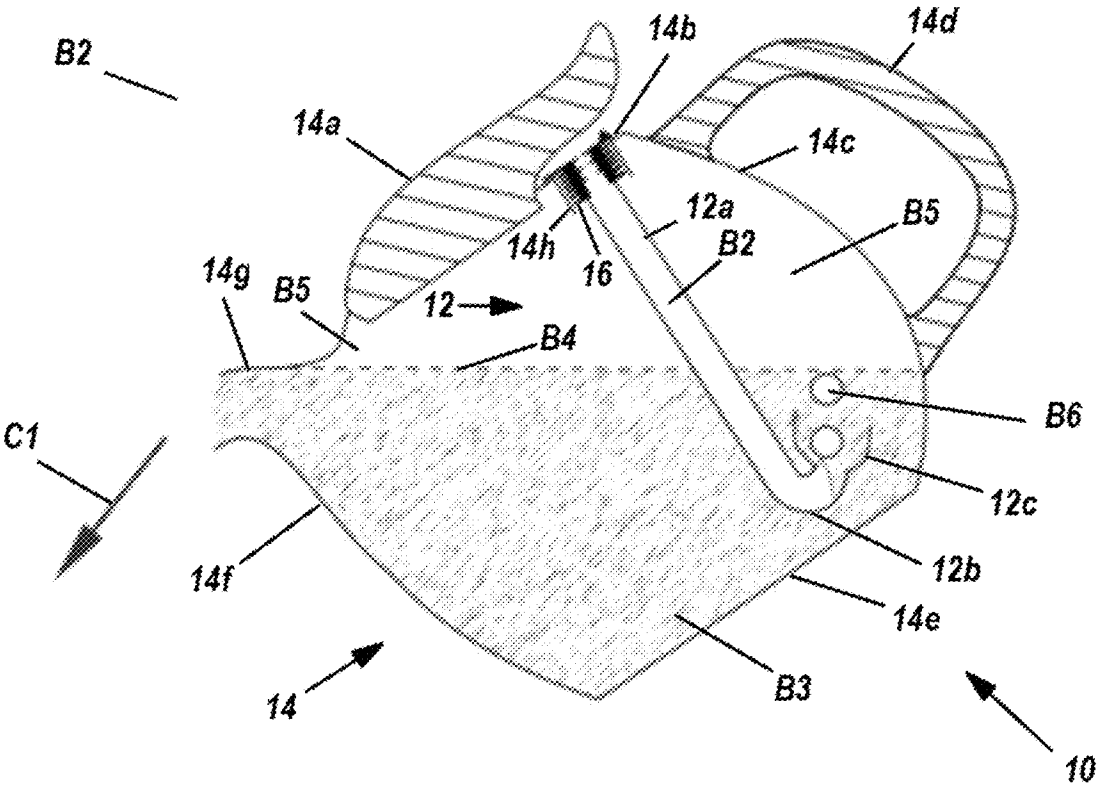
FIG. 17 is a side elevational cross-sectional view of the enhanced sound producing liquid container system of FIG. 6 in second tilted position and fourth liquid level condition.

Turning to FIG. 17, depicted therein is a side elevational cross-sectional view of enhanced container system 10 in second tilted position and fourth liquid level condition showing contained liquid level B4, contained air B5, and liquid B3 exiting container assembly 14 as indicated by dispensed liquid C1. At this point fluctuating flow of ambient air B2 in tubular member 12 is occurring, which results in fluctuating sound production of sound emitter 16.

Figure 18:
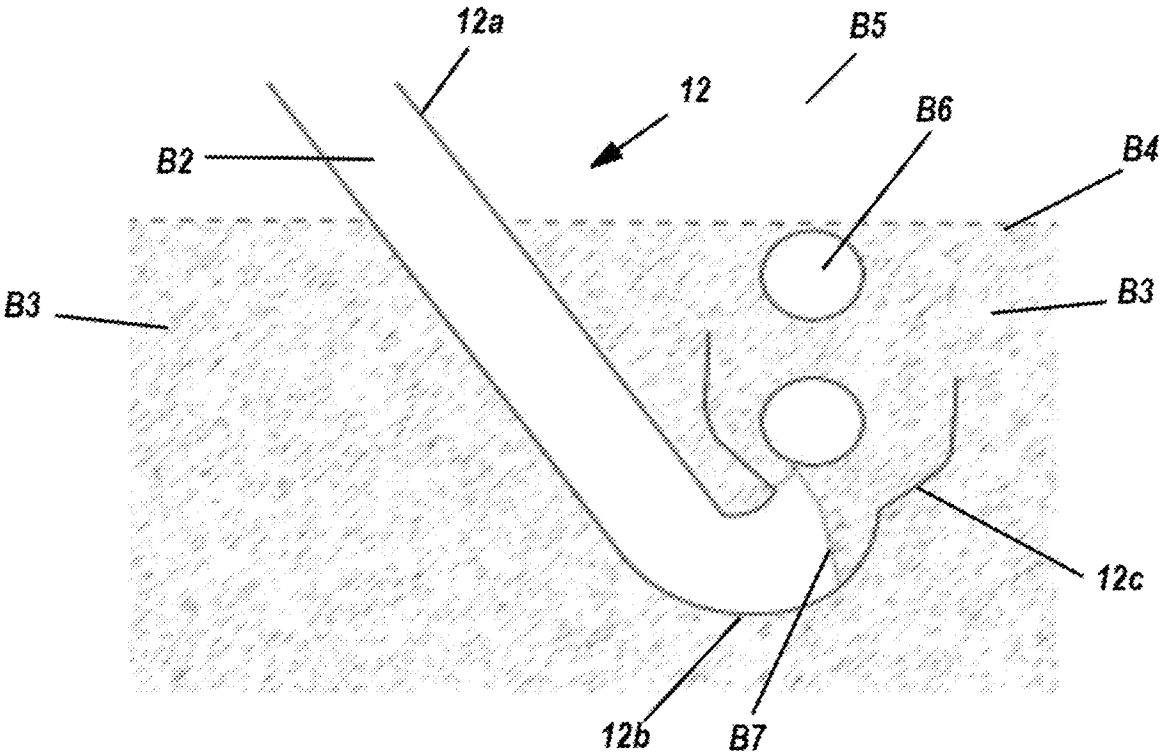
FIG. 18 is an enlarged side elevational cross-sectional view of a portion of the enhanced sound producing liquid container system of FIG. 6 in second tilted position and fourth liquid level condition.

Turning to FIG. 18, depicted therein is an enlarged side elevational cross-sectional view of a portion of enhanced container system 10 in second tilted position and fourth liquid level condition with bubble B6.

Figure 19:
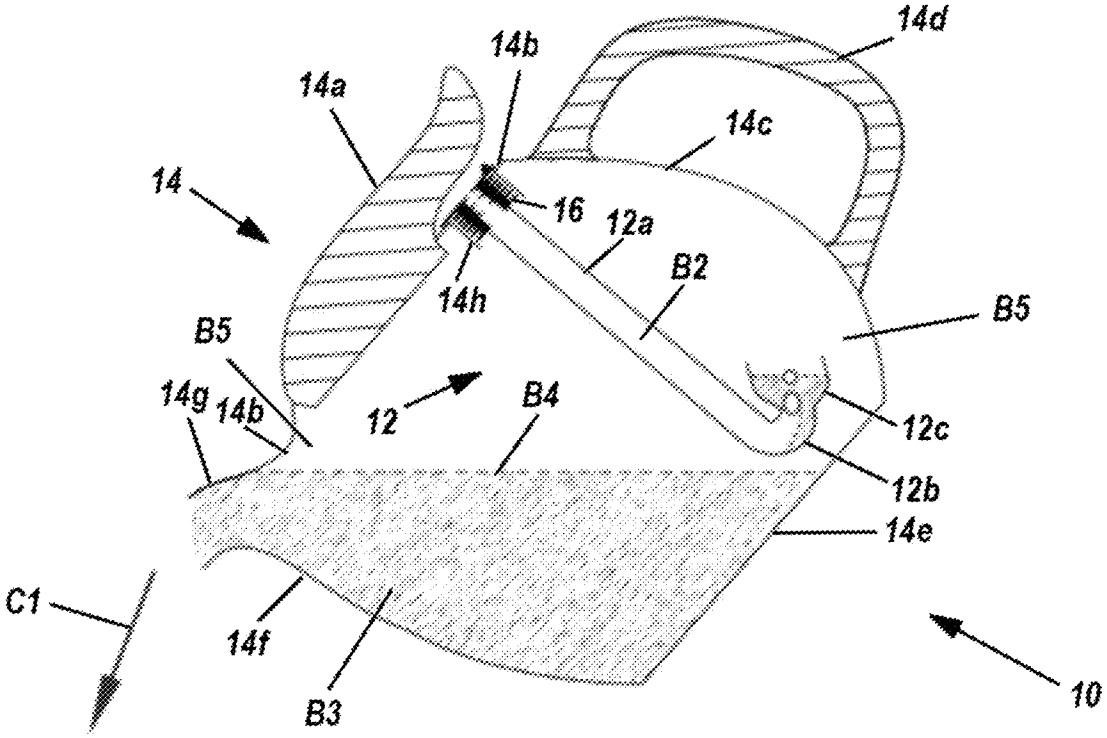
FIG. 19 is a side elevational cross-sectional view of the enhanced sound producing liquid container system of FIG. 6 in third tilted position and fifth liquid level condition.

Turning to FIG. 19, depicted therein is a side elevational cross-sectional view of enhanced container system 10 in third tilted position and fifth liquid level condition.

Figure 20:
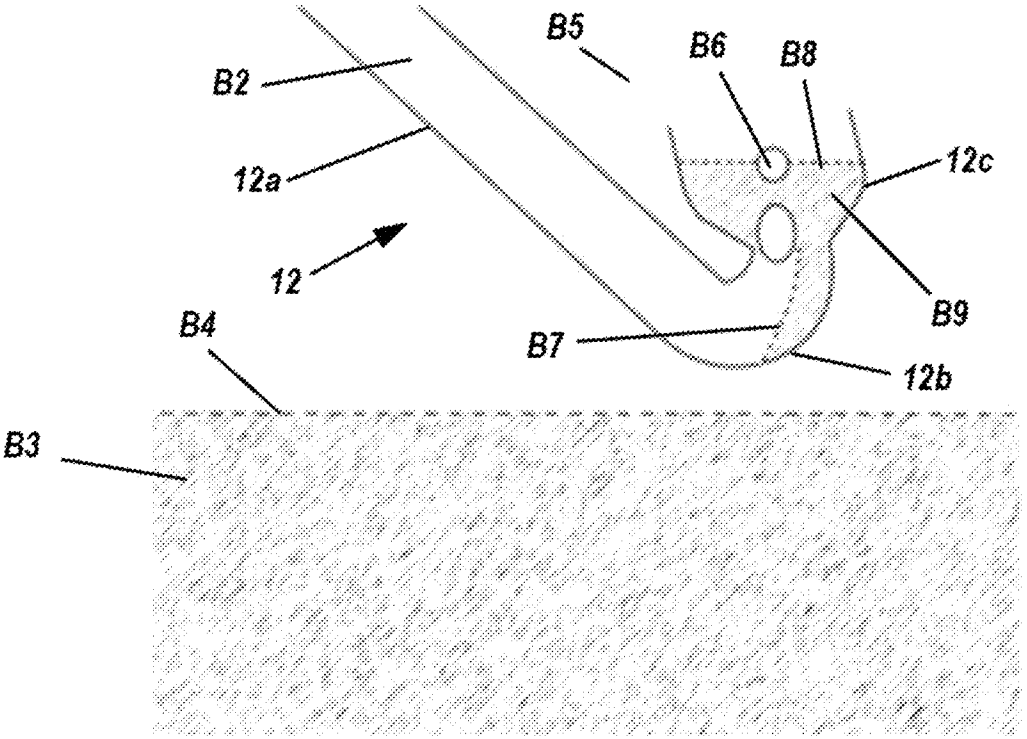
FIG. 20 is an enlarged side elevational cross-sectional view of a portion of the enhanced sound producing liquid container system of FIG. 6 in third tilted position and fifth liquid level condition.

Turning to FIG. 20, depicted therein is an enlarged side elevational cross-sectional view of a portion of enhanced container system 10 in third tilted position and fifth liquid level condition with ambient liquid level B7 of contained liquid level B8. Unlike conventional container system 100, as shown in FIGS. 4 and 5, enhanced container system 10 includes expanded portion 12*c* can retain a sufficient amount of liquid B9 to continue fluctuating flow of ambient air B2 in tubular member 12 to continue fluctuating sound production of sound emitter 16.

Figure 21:
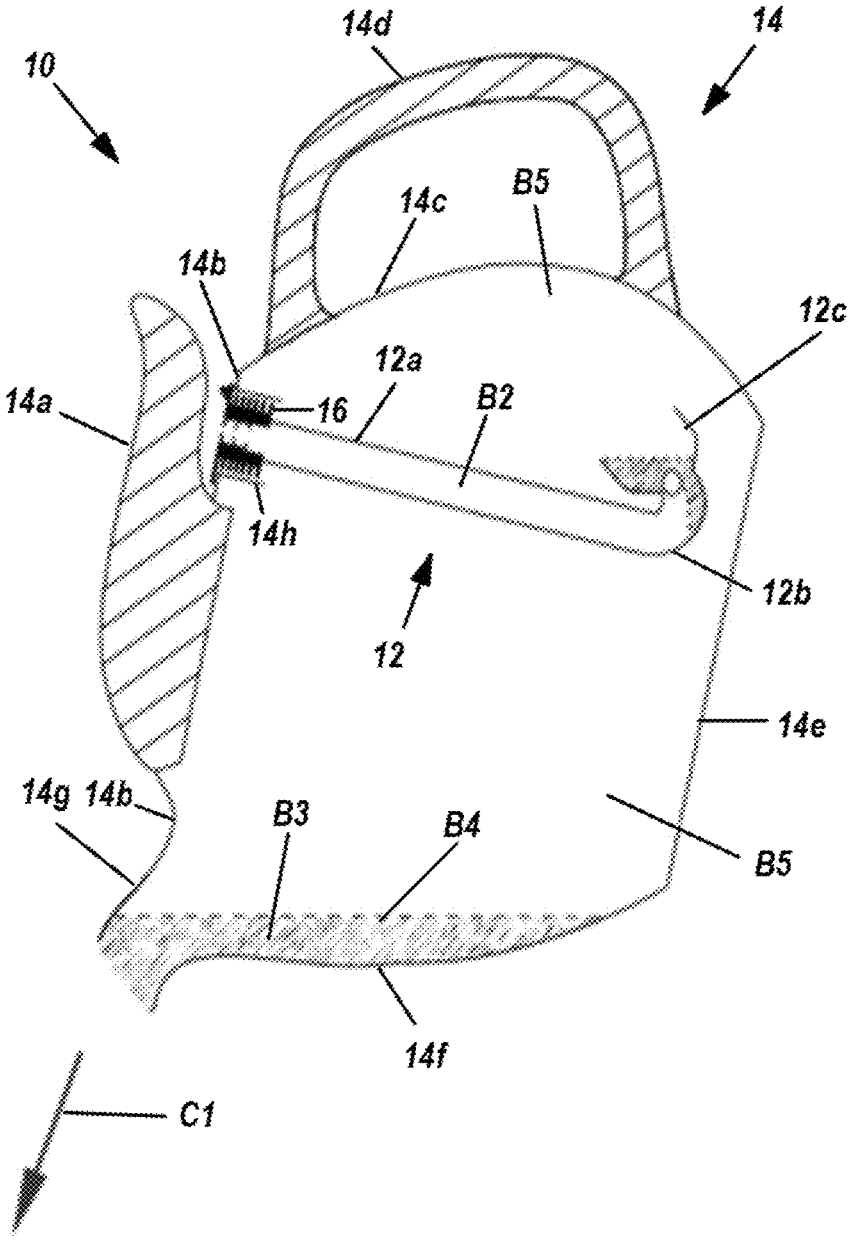
FIG. 21 is a side elevational cross-sectional view of the enhanced sound producing liquid container system of FIG. 6 in fourth tilted position and sixth liquid level condition.

Turning to FIG. 21, depicted therein is a side elevational cross-sectional view of enhanced container system 10 in fourth tilted position and sixth liquid level condition.

Figure 22:
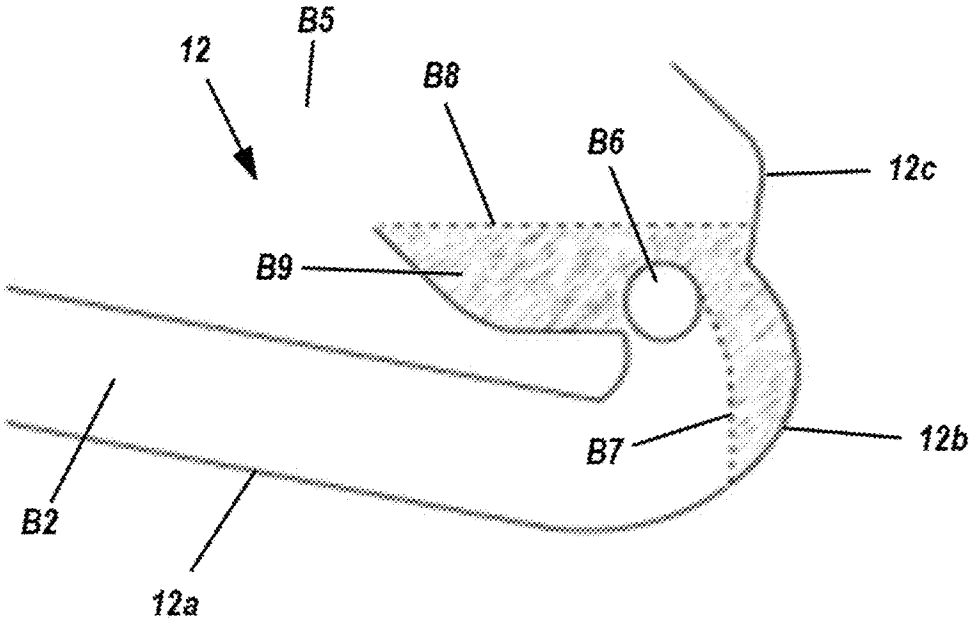
FIG. 22 is an enlarged side elevational cross-sectional view of a portion of the enhanced sound producing liquid container system of FIG. 6 in fourth tilted position and sixth liquid level condition.

Turning to FIG. 22, depicted therein is an enlarged side elevational cross-sectional view of a portion of enhanced container system 10 in fourth tilted position and sixth liquid level condition.

Figure 23:
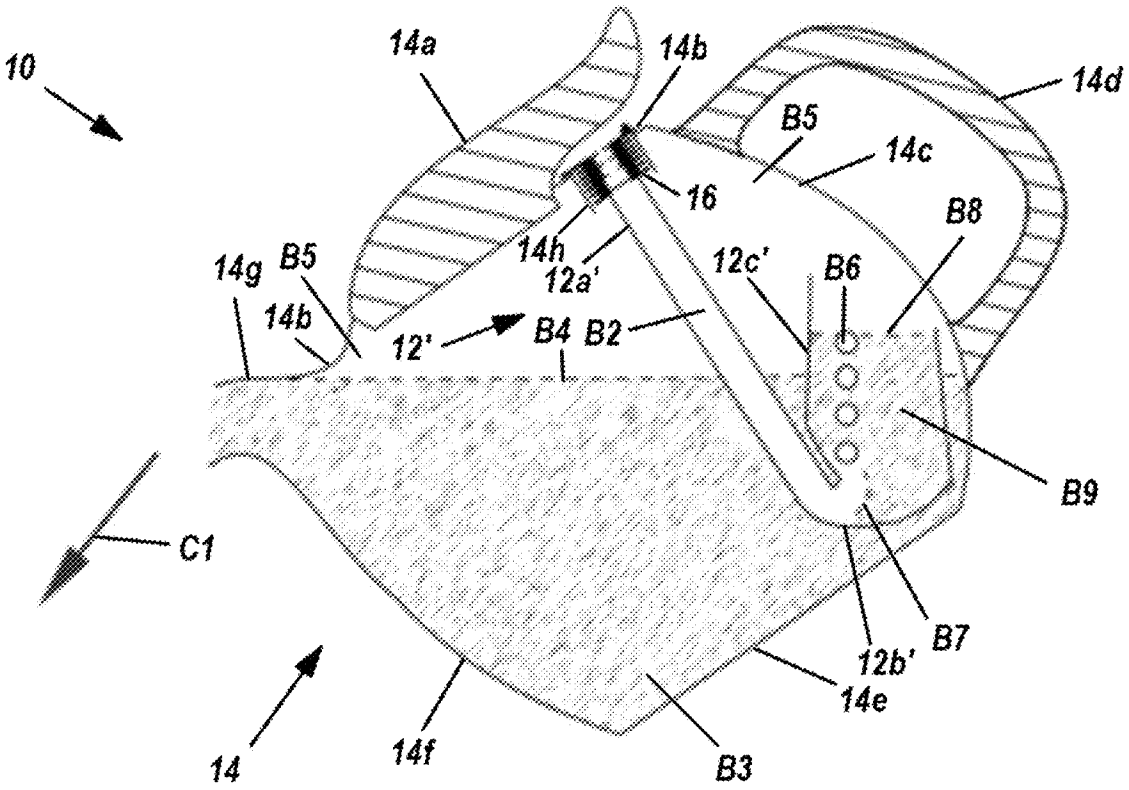
FIG. 23 is a side elevational cross-sectional view of a second implementation of enhanced sound producing liquid container system in second tilted position and fourth liquid level condition.

Turning to FIG. 23, depicted therein is a side elevational cross-sectional view of enhanced container system 10 in second tilted position and fourth liquid level condition. In implementations, enhanced container system 10 is shown to include tubular member 12' having longitudinal portion 12*a*', redirection portion 12*b*', and expanded portion 12*c*', which is shown as being oversized.

Figure 24:
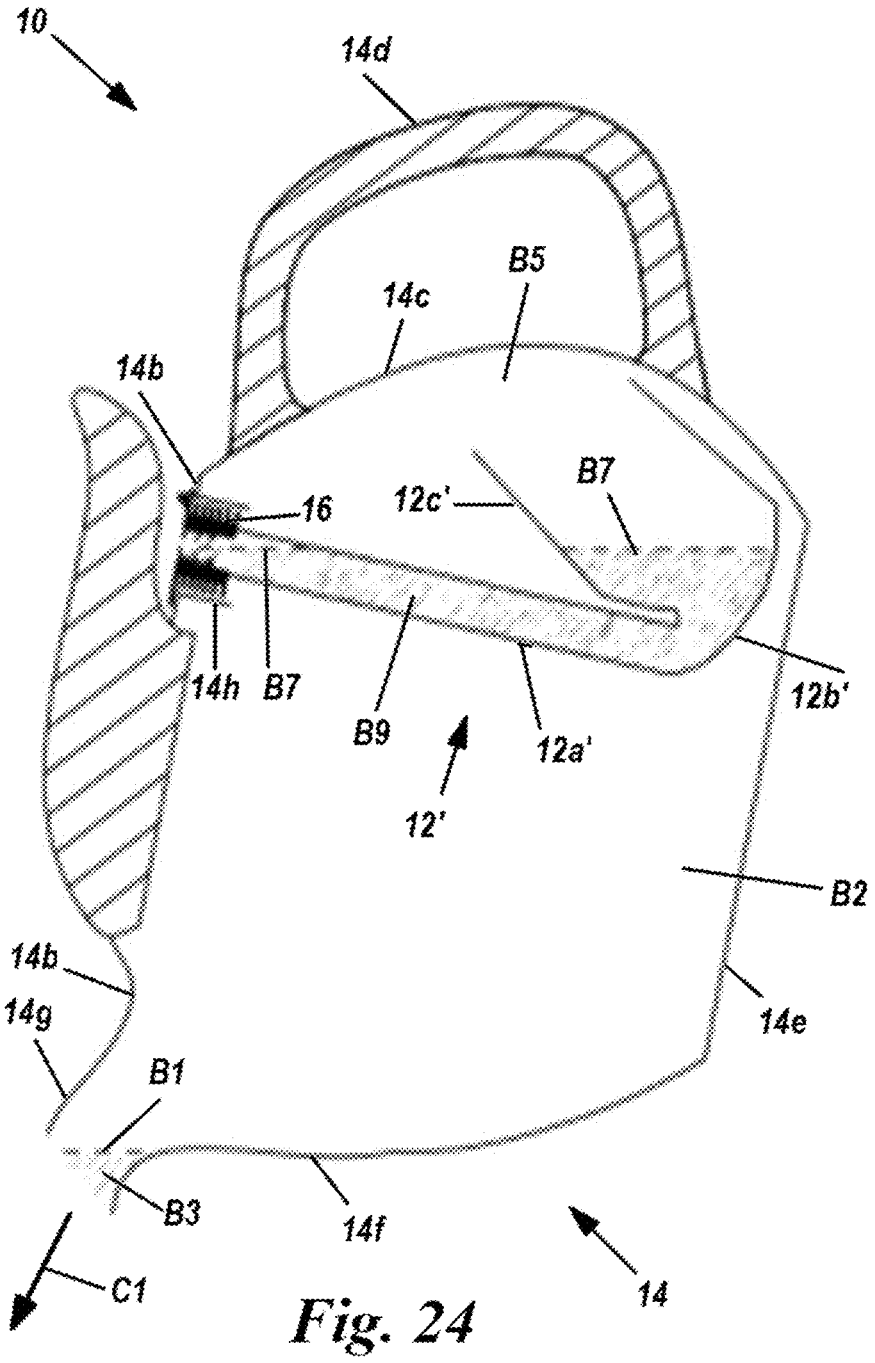
FIG. 24 is a side elevational cross-sectional view of the second implementation of enhanced sound producing liquid container system of FIG. 23 in fourth tilted position and sixth liquid level condition.

Turning to FIG. 24, depicted therein is a side elevational cross-sectional view of enhanced container system 10 in fourth tilted position and sixth liquid level condition, which shows the consequences of having an oversized expanded portion 12*c*', which at this fourth tilted position of enhanced container system 10 results in some of liquid B9 undesirably entering into sound emitter 16. In some implementations this undesirable entering of some of liquid B9 into sound emitter 16 can be reduced or eliminated by sizing volumes of various portions of tubular member 12 relative to one another. For instance, in some implementations the sum of volume of expanded portion 12*c* is sized relative to volume of redirection portion 12*b* such as volume of expanded portion 12*c* is greater than volume of redirection portion 12*b*.

Figure 25:
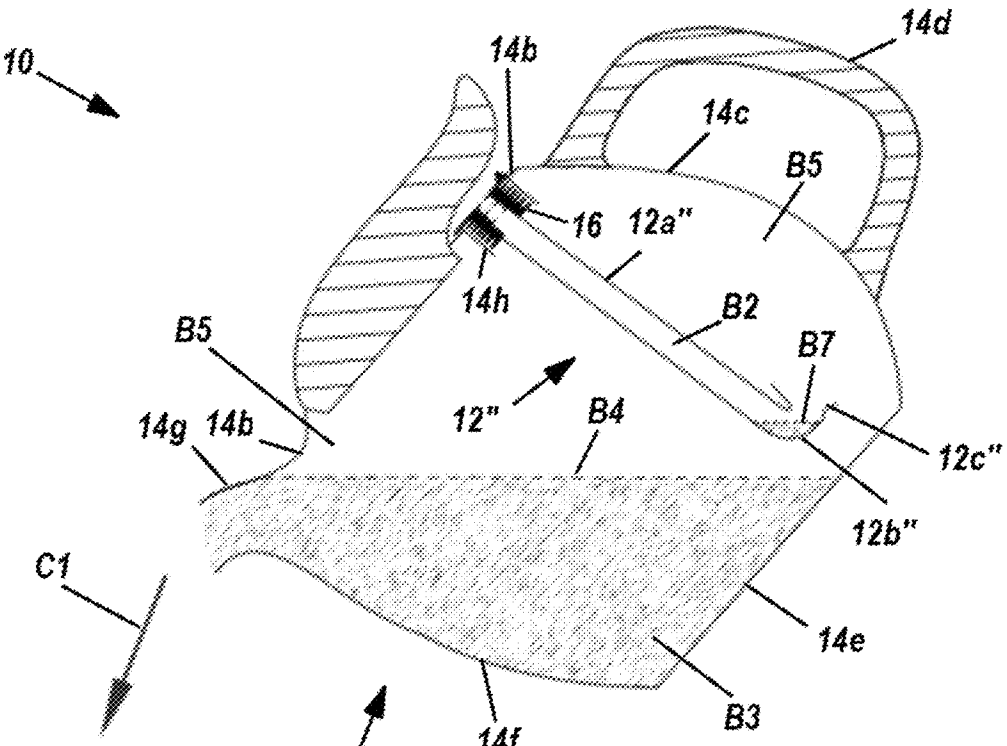
FIG. 25 is a side elevational cross-sectional view of a third implementation of enhanced sound producing liquid container system in third tilted position and fifth liquid level condition.

Turning to FIG. 25, depicted therein is a side elevational cross-sectional view of enhanced container system 10 in third tilted position and fifth liquid level condition. In implementations, enhanced container system 10 is shown to include tubular member 12" having longitudinal portion 12*a*", redirection portion 12*b*", and expanded portion 12*c*", which is shown as being undersized.

Figure 26:
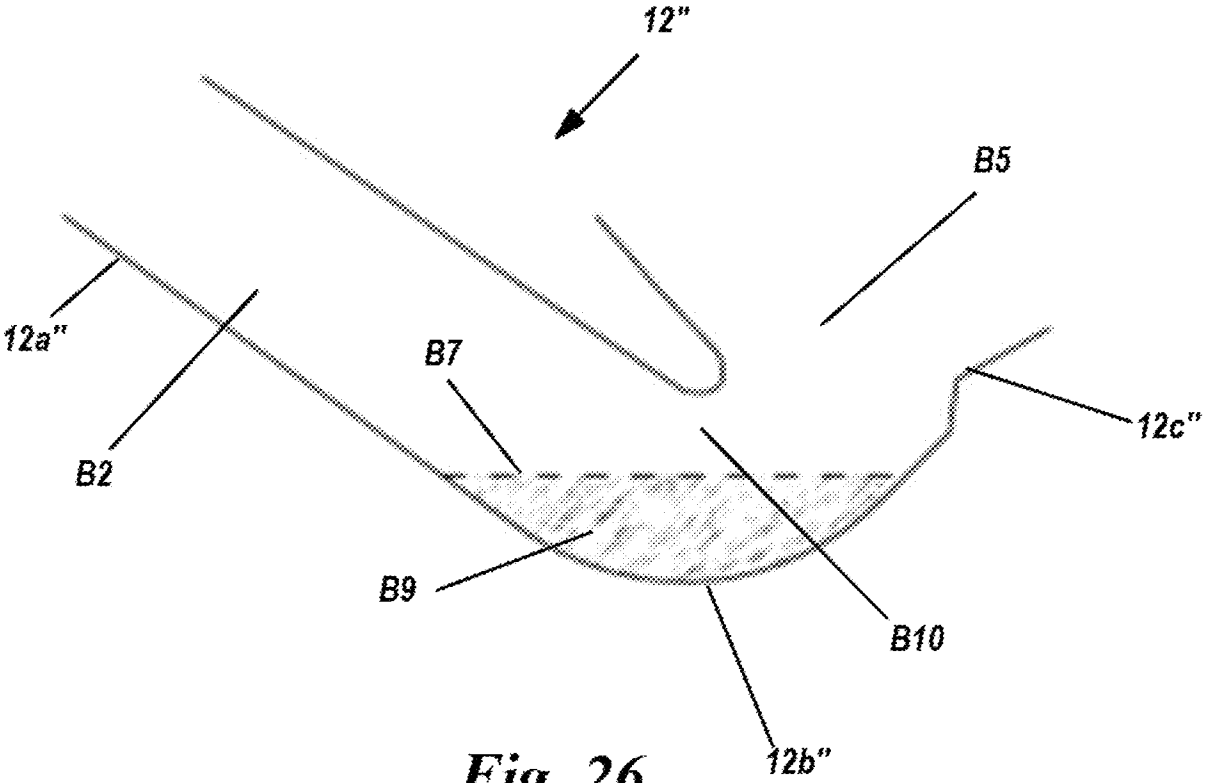
FIG. 26 is an enlarged side elevational cross-sectional view of a portion of the third implementation of enhanced sound producing liquid container system of FIG. 25 in third tilted position and fifth liquid level condition.

Turning to FIG. 26, depicted therein is an enlarged side elevational cross-sectional view of a portion of enhanced container system 10 in third tilted position and fifth liquid level condition. The consequences of having an undersized expanded portion 12*c*" are shown at this third tilted position of enhanced container system 10 resulting in ambient air B2 being able to travel through air passage B10 as a steady non-fluctuating flow thereby causing an undesirable steady sound, rather than a fluctuating sound, to be emitted by sound emitter 16. In some implementations this undesirable condition of ambient air B2 being able to travel through air passage B10 as a steady non-fluctuating flow can be reduced or eliminated by sizing various portions of tubular member 12 relative to one another. For instance, in some implementations the sum of volume of longitudinal portion 12*a* and volume of redirection portion 12*b* is sized relative to such as the sum of volume of longitudinal portion 12*a* and volume of redirection portion 12*b* is greater than volume of expanded portion 12*c*.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A container system comprising:

(I) a container including (A) a top portion;

(B) a bottom portion;

(C) at least one intermediate portion extending between the top portion and the bottom portion, wherein the top portion, the bottom portion, and the at least one intermediate portion at least partially form an interior of the container; and (II) a tubular member with a first end closer to the top portion than the bottom portion of the container and a second end closer to the bottom portion than the top portion of the container, the tubular member coupled with the top portion, the tubular member including (A) a longitudinal tubular portion coupled to the top portion of the container, (i) wherein the longitudinal tubular portion at least partially extends from the top portion toward the bottom portion, and (ii) wherein the longitudinal tubular portion includes a flow direction with a vectoral component oriented in a direction away from the top portion and toward the bottom portion, (B) an expanded tubular portion at least partially extending toward the top portion, (i) wherein the expanded tubular portion includes a flow direction with a vectoral component oriented in a direction away from the bottom portion and toward the top portion, and (ii) wherein the expanded tubular portion includes a maximum cross sectional flow area taken perpendicular to the flow direction, (iii) wherein the expanded tubular portion includes the second end of the tubular member as a free end, and (C) a flow redirection tubular portion positioned between the longitudinal tubular portion and the expanded tubular portion, (i) wherein the flow redirection tubular portion includes a plurality of flow directions including a first flow direction and a second flow direction, (a) wherein the first flow direction includes a vectoral component oriented in a direction away from the top portion and toward the bottom portion, and (b) wherein the second flow direction includes a vectoral component oriented in a direction toward the top portion and away from the bottom portion, (ii) wherein the flow redirection tubular portion includes cross sectional flow area taken perpendicular to the second flow direction, (iv) wherein the maximum cross sectional flow area of the expanded tubular portion is greater than the maximum cross sectional flow area of the flow redirection tubular portion, and (v) wherein the longitudinal tubular portion at least partially extends from the top portion toward the bottom portion for the expanded tubular portion to contain liquid acquired from the container including when liquid in the container includes at least one amount that is less than being maximum liquid containing capacity of the container.

2. The system of claim 1 further including a sound emitter, wherein the longitudinal tubular portion is coupled to the sound emitter, and wherein the longitudinal tubular portion at least partially extends from the top portion toward the bottom portion for the expanded tubular portion to contain liquid acquired from the container including when liquid in the container includes at least one amount that is half of maximum liquid containing capacity of the container.

3. The system of claim 1 wherein the first flow direction and the second flow direction of the flow redirection portion differ by at least 60 degrees.

4. The system of claim 1 wherein the flow direction of the longitudinal tubular portion and the first flow direction of the flow redirection portion differ by at least 30 degrees.

5. The system of claim 1 wherein the expanded tubular portion includes a plurality of cross sectional flow areas taken perpendicular to the flow direction of the expanded tubular portion, and wherein at least of portion of the plurality of cross sectional flow areas increase in size based on increasing distance away from the flow redirection portion along the flow direction of the expanded tubular portion.

6. The system of claim 1 wherein the longitudinal tubular portion includes a portion with a constant cross sectional flow area taken perpendicular to the flow direction of the longitudinal tubular portion.

7. The system of claim 1 wherein the longitudinal tubular portion includes a portion with a constant internal diameter taken perpendicular to the flow direction of the longitudinal tubular portion.

8. The system of claim 1 wherein the longitudinal tubular portion includes a volume, the redirection tubular portion includes a volume, and the expanded tubular portion includes a volume, and wherein the sum of the volume of the longitudinal tubular portion and the volume of the redirection tubular portion is greater than the volume of the expanded tubular portion.

9. The system of claim 1 wherein the redirection tubular portion includes a volume, and the expanded tubular portion includes a volume, and wherein the volume of the expanded tubular portion is greater than the volume of the redirection tubular portion.

10. The system of claim 1 wherein the plurality of flow directions of the flow redirection tubular portion includes a third flow direction equal to the flow direction expanded tubular portion, wherein the flow redirection tubular portion includes a maximum cross sectional flow area taken perpendicular to the third flow direction, wherein the expanded tubular portion includes a minimum cross sectional flow area taken perpendicular to the flow direction of the expanded tubular portion, and wherein the maximum cross sectional flow area taken perpendicular to the third flow direction of the redirection tubular portion is smaller than the cross sectional flow area of the second end of the tubular member as the free end of the expanded tubular portion.

11. The system of claim 1 wherein the at least one intermediate portion includes at least one curvilinear geometry.

12. The system of claim 1 further including a fluid outlet coupled in fluid communication with the at least one intermediate portion.

13. The system of claim 1 further including a fluid outlet coupled in fluid communication with the top portion.

14. The system of claim 1 wherein the container further includes a lid, and wherein the lid is removably coupled to the top portion of the container.

15. The system of claim 1 wherein the flow direction of the longitudinal tubular portion is not equal to any of the plurality of flow directions of the flow redirection tubular portion.

16. A container system comprising:

(I) a container including (A) a top portion;

(B) a bottom portion;

(C) at least one intermediate portion extending between the top portion and the bottom portion, wherein the top portion, the bottom portion, and the at least one intermediate portion at least partially form an interior of the container; and (II) a tubular member with a first end nearer to the top portion than the bottom portion of the container and a second end nearer to the bottom portion than the top portion of the container, the tubular member coupled with the top portion, the tubular member including (A) a longitudinal tubular portion coupled to the top portion of the container, (i) wherein the longitudinal tubular portion at least partially extends from the top portion toward the bottom portion, (ii) wherein the longitudinal tubular portion includes a flow direction with a vectoral component oriented in a direction away from the top portion and toward the bottom portion, and (iii) wherein the longitudinal tubular portion includes a maximum cross sectional flow area taken perpendicular to the flow direction, and (B) an expanded tubular portion at least partially extending toward the top portion, (i) wherein the expanded tubular portion includes a flow direction with a vectoral component oriented in a direction away from the bottom portion and toward the top portion, (ii) wherein the expanded tubular portion includes a maximum cross sectional flow area taken perpendicular to the flow direction, (iii) wherein the maximum cross sectional flow area of the longitudinal tubular portion is less than the maximum cross sectional flow area of the expanded tubular portion, and (iv) wherein the expanded tubular portion includes the second end of the tubular member without being coupled with any other tubular member, with the second end of the tubular member having a cross sectional flow area greater than the maximum cross sectional flow area of the longitudinal tubular portion, and (v) wherein the longitudinal tubular portion at least partially extends from the top portion toward the bottom portion for the expanded tubular portion to contain liquid acquired from the container including when liquid in the container includes at least one amount that is less than being maximum liquid containing capacity of the container.

17. The system of claim 16 wherein the longitudinal tubular portion includes a portion with a constant cross sectional flow area taken perpendicular to the flow direction of the longitudinal tubular portion, and wherein the longitudinal tubular portion at least partially extends from the top portion toward the bottom portion for the expanded tubular portion to contain liquid acquired from the container including when liquid in the container includes at least one amount that is half of maximum liquid containing capacity of the container.

18. The system of claim 16 wherein the longitudinal tubular portion includes a volume, the redirection tubular portion includes a volume, and the expanded tubular portion includes a volume, and wherein the sum of the volume of the longitudinal tubular portion and the volume of the redirection tubular portion is greater than the volume of the expanded tubular portion.

19. A container system comprising:

(I) a container including (A) a top portion;

(B) a bottom portion;

(C) at least one intermediate portion extending between the top portion and the bottom portion, wherein the top portion, the bottom portion, and the at least one intermediate portion at least partially form an interior of the container; and (II) a tubular member with a first end closer to the top portion than the bottom portion of the container and a second end closer to the bottom portion than the top portion of the container, the tubular member coupled with the top portion, the tubular member including (A) a longitudinal tubular portion coupled to the top portion of the container, (i) wherein the longitudinal tubular portion at least partially extends from the top portion toward the bottom portion, (ii) wherein the longitudinal tubular portion includes a flow direction with a vectoral component oriented in a direction away from the top portion and toward the bottom portion, and (iii) wherein the longitudinal tubular portion includes a cross sectional flow area taken perpendicular to the flow direction, and (B) an expanded tubular portion at least partially extending toward the top portion, the expanded tubular portion including the second end of the tubular member, (i) wherein the expanded tubular portion includes a flow direction with a vectoral component oriented in a direction away from the bottom portion and toward the top portion, (ii) wherein the expanded tubular portion includes a cross sectional flow area taken perpendicular to the flow direction, (iii) wherein the cross sectional flow area of the longitudinal tubular portion is less than to the cross sectional flow area of the expanded tubular portion, (iv) wherein the second end of the tubular member has a cross sectional flow area greater than the cross sectional flow area of the longitudinal tubular portion, and (v) wherein the second end of the tubular member is positioned and oriented for the expanded tubular portion to contain liquid acquired from the container including when liquid in the container includes at least one amount that is less than maximum liquid containing capacity of the container.

20. The system of claim 19 wherein the flow direction of the longitudinal tubular portion is not equal to any flow direction of the expanded tubular portion, and wherein the second end of the tubular member is positioned and oriented for the expanded tubular portion to contain liquid acquired from the container including when liquid in the container includes at least one amount that is half of maximum liquid containing capacity of the container.

* * * * *